US006935711B1

(12) United States Patent
Naue et al.

(10) Patent No.: US 6,935,711 B1
(45) Date of Patent: Aug. 30, 2005

(54) LATCH MOVER FOR QUICK-MOUNT SUPPORT FOR TELESCOPING SLIDE

(75) Inventors: Jeff L. Naue, New Palestine, IN (US); Phillip B. Cutler, Westfield, IN (US)

(73) Assignee: General Devices Co., Inc., Indianapolis, IN (US)

( * ) Notice: Subject to any disclaimer, the term of this patent is extended or adjusted under 35 U.S.C. 154(b) by 0 days.

(21) Appl. No.: 10/787,712

(22) Filed: Feb. 26, 2004

(51) Int. Cl.[7] ..... A47B 88/00
(52) U.S. Cl. ..... 312/334.4; 312/223.1
(58) Field of Search ..... 312/334.4, 334.5, 312/330.1, 265.1, 265.4, 223.1, 334.7, 350; 211/26; 384/22; 361/725, 727

(56) References Cited

U.S. PATENT DOCUMENTS

| | | | |
|---|---|---|---|
| 516,583 | A | 3/1894 | Adkins |
| 1,698,252 | A | 1/1929 | Ashe |
| 2,644,588 | A | 7/1953 | Brown |
| 2,749,200 | A | 6/1956 | Kuss |
| 2,809,086 | A | 10/1957 | Fall |
| 3,054,511 | A | 9/1962 | Erismann |
| 3,133,768 | A | 5/1964 | Klakovich |
| 3,601,432 | A | 8/1971 | Fenwick et al. |
| 4,049,230 | A | 9/1977 | Minniear |
| 4,106,738 | A | 8/1978 | Kostecky |
| 4,423,914 | A | 1/1984 | Vander Ley |
| 4,441,722 | A | 4/1984 | Pichler |
| 4,441,772 | A | 4/1984 | Fielding et al. |
| 4,474,492 | A | 10/1984 | Fleitas |
| 5,063,715 | A | 11/1991 | Goodman |
| 5,199,777 | A | 4/1993 | Taima et al. |
| 5,292,198 | A | 3/1994 | Rock et al. |
| 5,405,195 | A | 4/1995 | Hobbs |
| 5,433,517 | A | 7/1995 | Fleisch |
| 5,580,138 | A | 12/1996 | Grabber |
| 5,620,244 | A | 4/1997 | Yang |
| 5,632,542 | A | 5/1997 | Krivec |
| 5,671,988 | A | 9/1997 | ONeill |
| 5,683,159 | A | 11/1997 | Johnson |
| 5,730,514 | A | 3/1998 | Hashemi |
| 5,823,648 | A | 10/1998 | Domenig |
| 5,904,412 | A | 5/1999 | Lammens |
| 6,027,194 | A | 2/2000 | Fleisch |
| 6,209,979 | B1 | 4/2001 | Fall et al. |
| 6,273,534 | B1 | 8/2001 | Bueley et al. |
| 6,422,399 | B1 | 7/2002 | Castillo et al. |
| 6,749,275 | B2 * | 6/2004 | Cutler et al. ..... 312/334.4 |
| 2004/0089779 | A1 * | 5/2004 | Greenwald et al. ..... 248/241 |
| 2004/0094492 | A1 * | 5/2004 | Greenwald et al. ..... 211/26 |

FOREIGN PATENT DOCUMENTS

| | | |
|---|---|---|
| CA | 817754 | 7/1969 |

* cited by examiner

*Primary Examiner*—Janet M. Wilkens
(74) *Attorney, Agent, or Firm*—Barnes & Thornburg LLP

(57) ABSTRACT

A telescoping slide support assembly includes a telescoping slide assembly, a vertical rack for use in an equipment cabinet, and a quick-mount support coupled to a stationary slide included in the telescoping slide assembly. The quick-mount support includes a movable latch and a linkage for moving the movable latch about a pivot axis to facilitate coupling and uncoupling of the quick-mount support and the vertical rack.

34 Claims, 5 Drawing Sheets

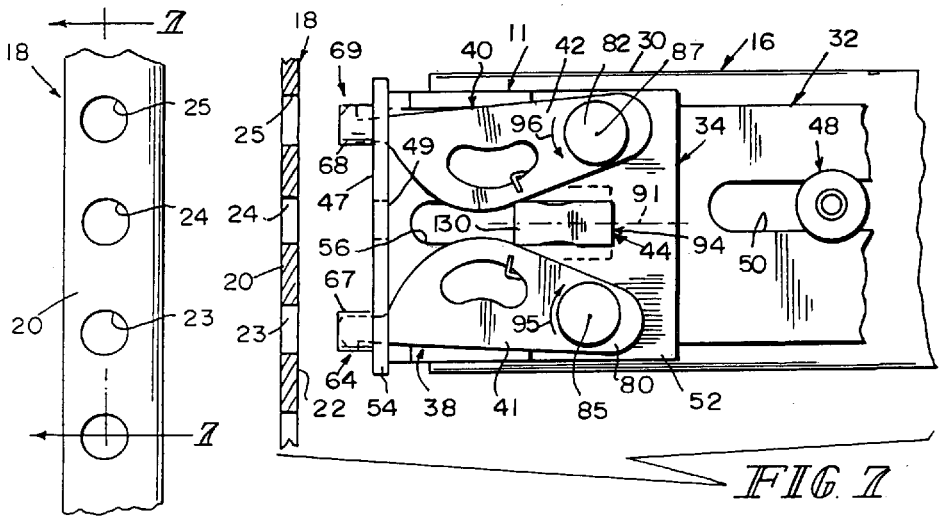
FIG. 7
FIG. 6
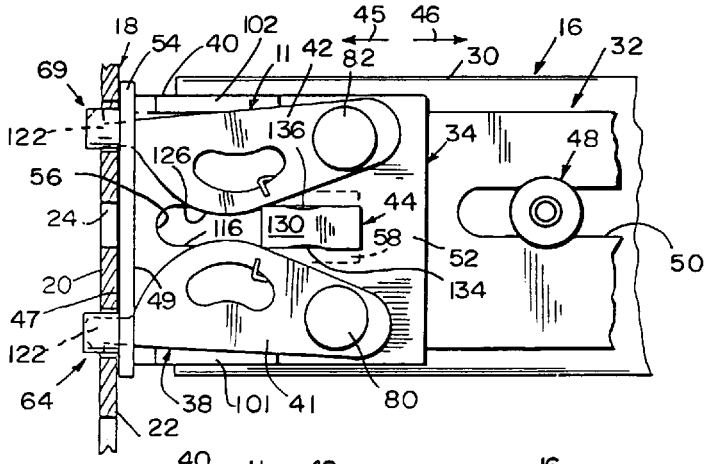
FIG. 8
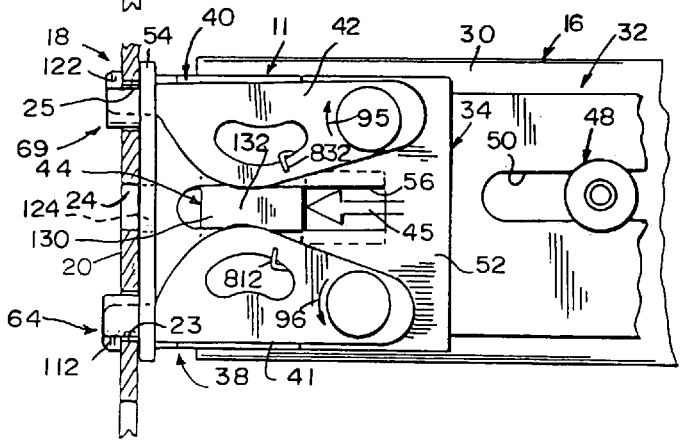
FIG. 9

LATCH MOVER FOR QUICK-MOUNT SUPPORT FOR TELESCOPING SLIDE

BACKGROUND

The present disclosure relates to telescoping slide assemblies, and particularly to telescoping slide assemblies mounted on racks to support a piece of equipment for movement relative to the rack. More particularly, the present disclosure relates to bracket systems for mounting telescoping slide assemblies on racks included in an equipment cabinet.

SUMMARY

A telescoping slide assembly support system in accordance with the present disclosure includes a telescoping slide assembly, a vertical rack for use in an equipment cabinet, and a quick-mount support coupled to a stationary slide included in the telescoping slide assembly. The quick-mount support is configured to be coupled quickly and easily to the rack to facilitate mounting the stationary slide in a fixed position relative to the rack. A load-carrying slide also included in the telescoping slide assembly can be coupled to a piece of equipment to support that equipment for movement relative to the rack into and out of the equipment cabinet.

In illustrative embodiments of the present disclosure, the quick-mount support includes bottom and top latches pivotably coupled to a mount unit and sized to extend through latch apertures formed in the rack when the quick-mount support is coupled to the rack. Spring material is coupled to the mount unit and to the bottom and top latches to pivot the latches toward one another so that the latches are aligned to extend through two of the latch apertures formed in the rack as a technician moves the quick-mount support toward engagement with the rack during the coupling process.

A latch mover included in the quick-mount support can be moved in a first direction in a guide slot formed in the mount unit to spread the pivotable bottom and top latches apart against biasing force provided by the spring material to cause latch lugs included in the bottom and top latches to move to a "spread-apart" position to confront the rack so that uncoupling of the quick-mount support and the rack is blocked. The latch mover can also be moved by a technician in an opposite, second direction in the guide slot to allow the bottom and top latches to be pivoted by the spring material to a retracted "drawn-together" position so that the latches can be removed from the latch apertures formed in the rack during uncoupling of the quick-mount support and the rack.

The quick-mount support further includes a first split-cylinder alignment guide associated with the bottom latch and a second split-cylinder alignment guide associated with the top latch. Each latch extends through and is movable in a channel formed in its companion split-cylinder alignment guide to engage or disengage the rack. Each split-cylinder alignment guide extends through one of the latch apertures formed in the rack to orient the quick-mount support in a predetermined position relative to the rack to facilitate coupling of the quick-mount support to the rack.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 6 is an elevation view of the vertical rack shown in FIG. 4 showing a "perforated" front wall formed to include four latch apertures;

FIG. 7 is a sectional view taken along line 7—7 of FIG. 6 and showing the quick-mount support of FIGS. 4–7 before it is coupled to the perforated front wall of the vertical rack and showing that each of those latches is poised to pass into one of the latch apertures formed in the front wall of the vertical rack, an aperture formed in a mounting bracket, the pivotable bottom latch being urged by a first spring to a "raised and unlocked" position, the pivotable top latch being urged by a second spring to a "lowered and unlocked" position;

FIG. 8 is a sectional view similar to FIG. 7 showing movement of a rack mount in the quick-mount support to engage a rearwardly facing surface of the perforated front wall of the vertical rack and to extend the raised bottom latch into one of the latch apertures formed in the front wall and to extend the lowered top latch into another of the latch apertures;

FIG. 9 is a sectional view similar to FIGS. 7 and 8 showing the quick-mount support anchored to the vertical rack after sliding movement (to the left) of a latch mover located between the top and bottom latches to move (1) the bottom latch against the first spring to a "lowered and locked" position and (2) the top latch against the second spring to a "raised and locked" position to cause the stationary slide of the telescoping slide assembly to be held in a fixed position relative to the vertical rack provided in the cabinet as shown in FIGS. 2 and 3.

DETAILED DESCRIPTION

Figure 1:
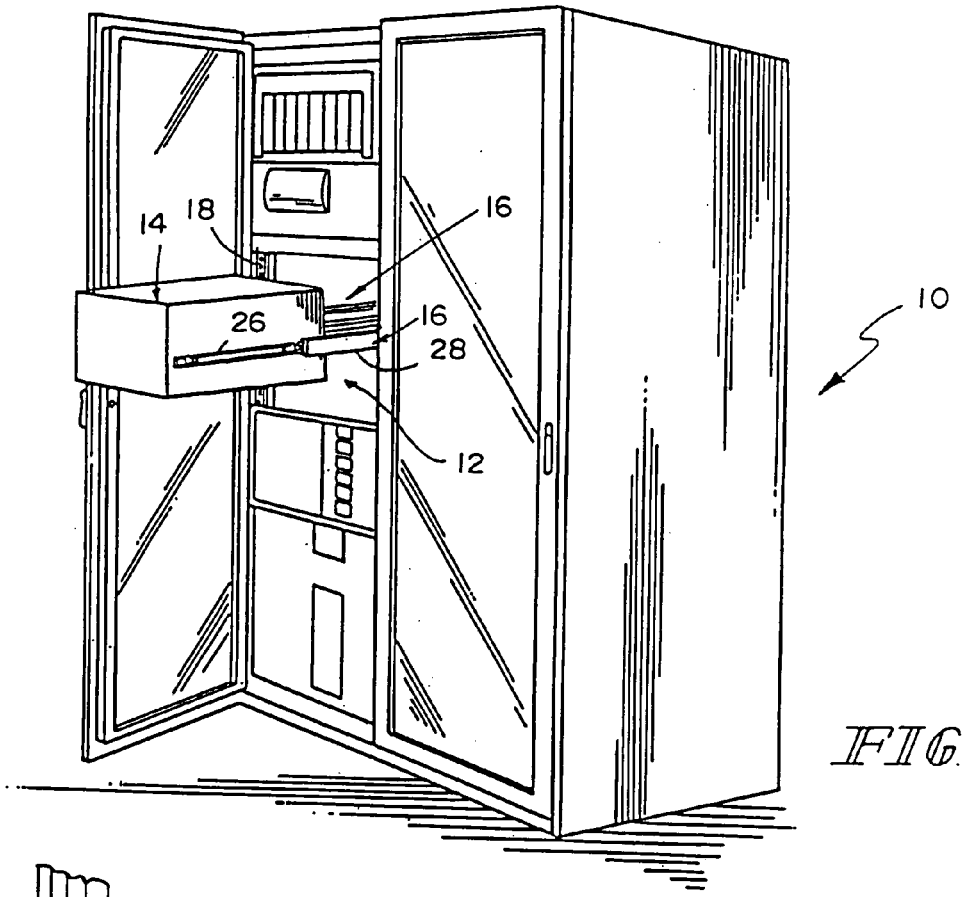
FIG. 1 is a perspective view showing a piece of equipment mounted on two fully extended telescoping slide assemblies that are mounted on vertical racks provided inside a cabinet to enable a technician to move the piece of equipment easily into and out of the cabinet.
Figure 2:
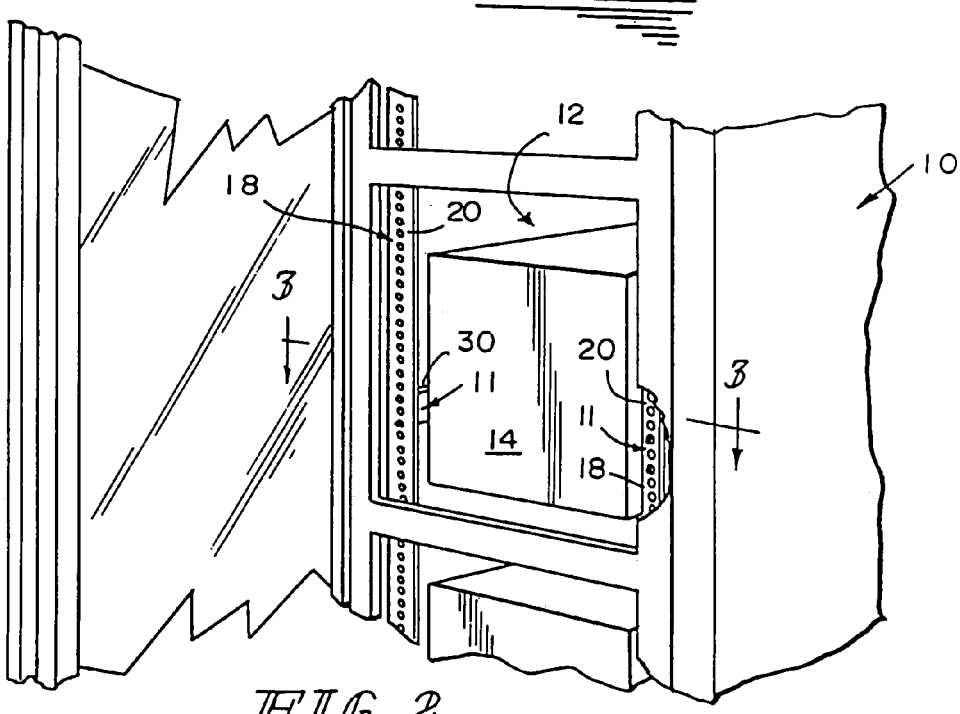
FIG. 2 is a partial perspective view of the cabinet of FIG. 1, with portions broken away, showing the piece of equipment located inside the cabinet owing to the full retraction of the telescoping slide assemblies inside the cabinet and showing two forward vertical racks and a series of latch apertures formed in each of the forward vertical racks wherein two latches associated with a quick-mount support coupled to a "left-side" slide assembly extend into two of the latch apertures formed in a left-side forward vertical rack and two latches associated with a quick-mount support coupled to a "right-side" slide assembly extend into two of the latch apertures formed in a right-side forward vertical rack.
Figure 3:
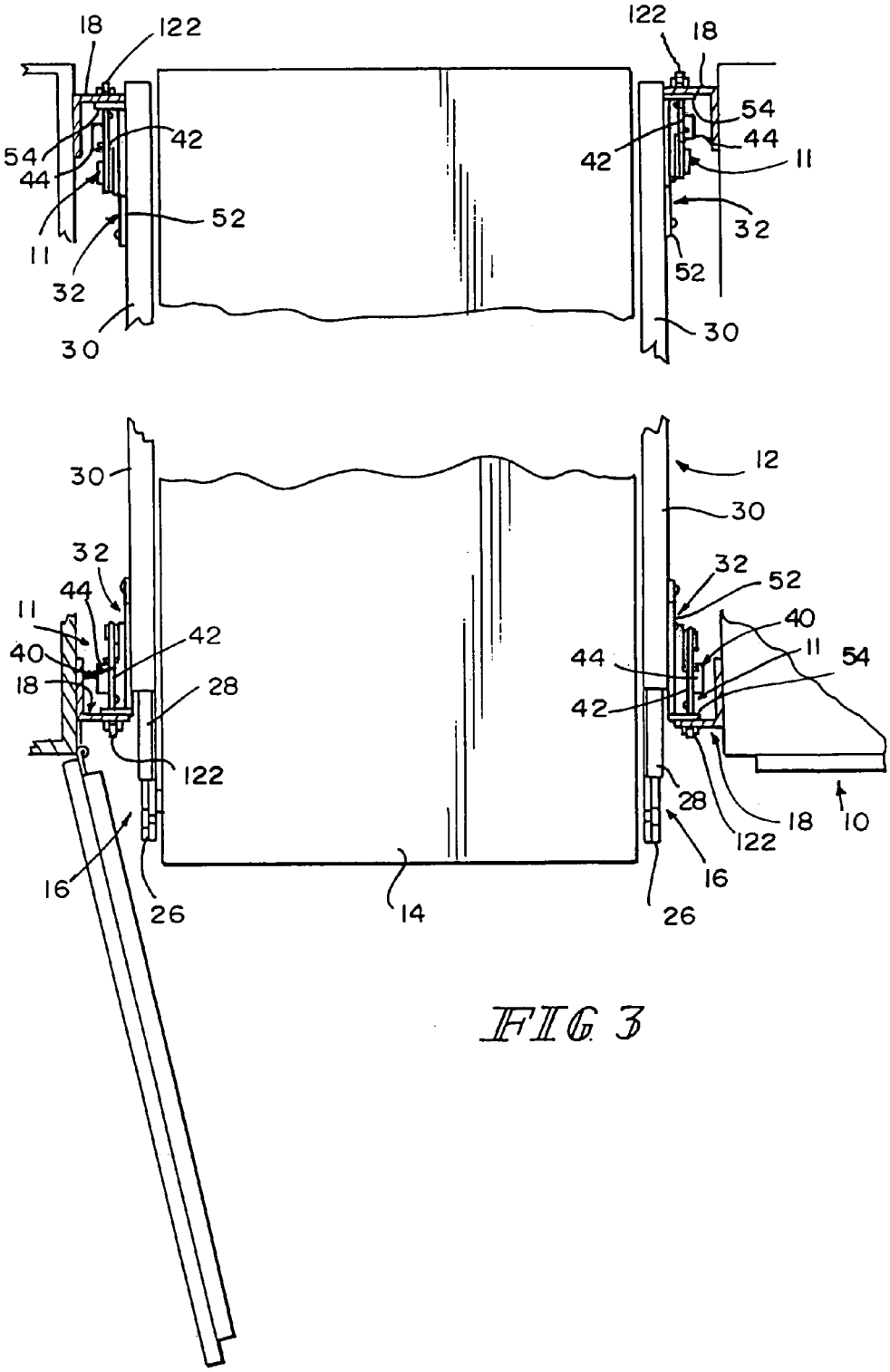
FIG. 3 is a sectional view taken along line 3—3 of FIG. 2 after the piece of equipment has been moved on the telescoping slide assemblies a short distance out of the cabinet showing a pair of spaced-apart three-part telescoping slide assemblies, a piece of equipment mounted therebetween, and four quick-mount supports and showing that each quick-mount support is coupled to one of the forward and rearward vertical racks and to a nearby portion of one of the telescoping slide assemblies to anchor the slide assemblies to the vertical racks.

An equipment cabinet 10 includes an interior region 12 adapted to store equipment therein as shown, for example, in FIGS. 1 and 2. A piece of equipment 14 is mounted on a pair of spaced-apart telescoping slide assemblies 16 for movement thereon between a fully extended position away from cabinet 10 as shown in FIG. 1 and a fully retracted position within cabinet 10 as shown in FIG. 2. Vertical racks 18 are mounted in cabinet 10 as shown, for example, in FIGS. 1–3 and telescoping slide assemblies 16 are mounted to these vertical racks 18 using the quick-mount support system disclosed herein and shown, for example, in FIGS. 4–10.

Each vertical rack 18 includes a forwardly facing surface 20, a rearwardly facing surface 22, and a series of latch apertures 23, 24, 25, etc., as shown, for example, in FIGS. 4 and 6–9. Each vertical rack 18 is coupled to equipment cabinet 10 and positioned to lie in the interior region 12 as shown, for example, in FIG. 3. It is within the scope of this disclosure to configure and orient rack 18 to support slide assemblies in a wide variety of locations within cabinet 10. In many instances, rack 18 will have a "vertical" orientation but other orientations fall within the scope of this disclosure.

Telescoping slide assembly 16 includes any suitable number of slides. In the illustrations, telescoping slide assembly 16 includes interconnected load-carrying slide 26, intermediate slide 28, and stationary slide 30. These slides 26, 28, and 30 are movable relative to one another to extend and retract load-carrying slide 26 relative to stationary slide 30 between fully extended and retracted positions as suggested in FIGS. 1 and 2. Piece of equipment 14 is coupled to spaced-apart load-carrying slides 26 in any suitable manner as shown, for example, in FIG. 3. It is within the scope of this disclosure to omit intermediate slide 28 or add additional intermediate slides (not shown).

A pair of quick-mount supports 11 is provided so that each end of each stationary slide 30 can be mounted to an adjacent vertical rack 18 quickly and easily. Thus, the telescoping slide assemblies 16 used to support equipment 14 are positioned to lie in spaced-apart parallel relation to one another in fixed positions on vertical racks 18. Quick-mount support 11 can be operated quickly and easily by a technician provided with access to interior region 12 of equipment cabinet 10 to couple quick-mount support 11 to vertical rack 18 as shown in FIGS. 7–9.

Quick-mount support 11 includes a slide support bracket 32 coupled to stationary slide 30 and a retainer mechanism 34 coupled to slide support bracket 32 and configured to mate easily to vertical rack 18 so that quick-mount support 11 can be coupled to and uncoupled from vertical rack 18 quickly and easily in a manner suggested in FIGS. 7–9. Fasteners 48 can be arranged to extend through apertures or position-adjustment slot 50 formed in slide support bracket 32 to engage stationary slide 30 so that slide support bracket 32 is mounted in a fixed position on one end of stationary slide 30.

Figure 4:
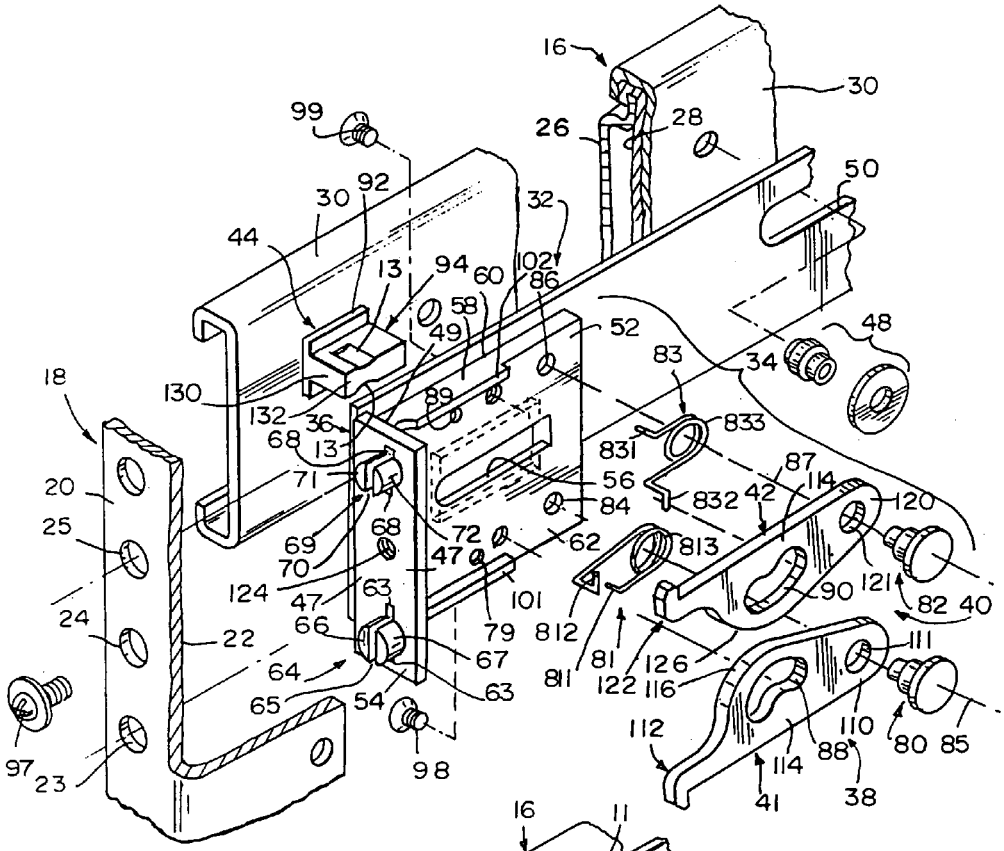
FIG. 4 is an enlarged perspective assembly view of various components that can be assembled as shown, for example, in FIG. 5, to produce a quick-mount support in accordance with this disclosure.

As suggested in FIG. 4, quick-mount support 11 further includes a connector 97 arranged to pass through aligned apertures 24, 124 formed, respectively, in each of rack 18 and rack mount 54. Fasteners 98 and 99 can be used to couple retainer mount 52 to slide support bracket 32 as also suggested in FIG. 4.

Figure 5:
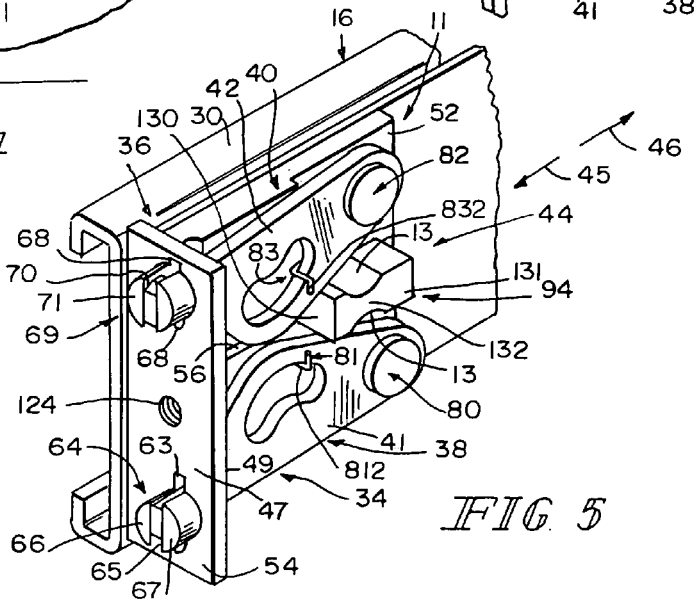
FIG. 5 is an enlarged perspective view of the quick-mount support of FIG. 4 after it has been assembled and mounted on one end of a stationary slide included in the three-part telescoping slide assembly and showing pivotable top and bottom latches, each latch having a latch lug extending through a slot formed in a mount unit and lying within a channel formed in a split-cylinder alignment guide.

Retainer mechanism 34 includes a mount unit 36, a lower retainer 38, and an upper retainer 40 as shown best in FIGS. 4 and 5. Each retainer 38, 40 includes a movable latch (e.g., 41 and 42, respectively). Retainer mechanism 34 further includes a latch mover 44 movable by a technician in a first direction 45 to move latches 41 and 42 apart to assume a spread-apart position, as suggested in FIGS. 7–9, to mate latches 41, 42 of quick-mount support 11 with rack 18. Latch mover 44 is also movable by a technician in an opposite section direction 46 to allow latches 41 and 42 to move toward one another to assume a drawn-together position using force generated by spring material coupled to at least one of the latches 41, 42 to uncouple latches 41, 42 of quick-mount support 11 from rack 18. It is within the scope of this disclosure to mount latches 41, 42 to mount unit 36 to pivot, slide, or otherwise move relative to mount unit 36 during coupling and uncoupling of quick-mount support 11 and rack 18.

Mount unit 36 includes a retainer mount 52 coupled to slide support bracket 32 and a rack mount 54 arranged to lie at a right angle to retainer mount 52 as shown, for example, in FIGS. 4 and 5. In the illustrated embodiment, retainer mount 52 is established by a first metal plate welded or otherwise secured to a second metal plate establishing the rack mount 52. It is within the scope of this disclosure to form mount unit 36 of a monolithic metal or plastics material.

As suggested in FIGS. 4 and 5, retainer mount 52 is formed to include a guide slot 56 and latch mover 44 is arranged to move back and forth in guide slot 56 during coupling and uncoupling of quick-mount support 11 and rack 18. As shown in FIG. 4, retainer mount 52 is formed to include a base receiver 58 having an opening in an inner wall 60 of retainer mount 52 and communicating with guide slot 56. Inner wall 60 of retainer mount 52 faces toward load-carrying slide 26 and outer wall 62 of retainer mount 52 faces away from load-carrying slide 26 as suggested in FIG. 4.

Rack mount 54 is adapted to mate with rack 18 when quick-mount support 11 is coupled to rack 18 as suggested in FIGS. 3 and 7–9. Rack mount 54 includes a forwardly facing surface 47 and a rearwardly facing surface 49. Forwardly facing surface 47 of rack mount 54 is arranged to lie in mating relation to rearwardly facing surface 22 of rack 18 to align latch apertures formed in rack 18 with various latch-receiving slots and channels formed in rack mount 54 as suggested in FIGS. 7 and 9. It is within the scope of this disclosure to place an intervening element between rack mount 54 and rack 18 so long as both of the movable latches 41, 42 are able to extend through and move in companion latch-receiving slots and channels formed in rack mount 54 and latch apertures formed in rack 18.

As suggested in FIG. 4, rack mount 54 of mount unit 36 is formed to include first and second slots 63, 68, a first alignment guide 64 associated with first slot 63, and a second alignment guide 69 associated with second slot 68. Alignment guides 64, 69 are used to orient quick-mount support 11 (and particularly rack mount 54) in a predetermined position relative to rack 18 as suggested in FIGS. 3, 7, and 8 to facilitate coupling of the quick-mount support 11 to the rack 18.

First alignment guide 64 is coupled to rack mount 54 of mount unit 36 and formed to include a first channel 65 communicating with first slot 63 in rack mount 54. In the illustrated embodiment, first alignment guide 64 comprises a pair of first tabs 66, 67 arranged to form first channel 65 therebetween. Second alignment guide 69 is coupled to rack mount 54 of mount unit 36 and formed to include a second channel 70 communicating with second slot 68 in rack mount 54. Also in the illustrated embodiment, second alignment guide 69 comprises a pair of second tabs 71, 72 arranged to form second channel 70 therebetween. Also in the illustrated embodiment, each of first tabs 66, 67 and second tabs 71, 72 has a partial cylindrical shape with an outwardly presented curved exterior surface and an inwardly presented flat interior surface. Pairs of tabs having such a shape cooperate to define a "split-cylinder" alignment guide. It is within the scope of this disclosure to vary the shape and number of tabs in each alignment guide.

As suggested in FIGS. 4 and 6–8, first alignment guide 64 is arranged to extend through latch aperture 23 formed in rack 18 and second alignment guide 69 is arranged to extend through latch aperture 25 formed in rack 18 so that rack mount 54 is oriented properly with respect to rack 18 to allow latches 41, 42 to extend into the slots and channels formed in rack mount 54 and latch apertures formed in rack 18. The outwardly presented curved exterior surfaces of first tabs 66, 67 fit into and mate with a circular inner edge of latch aperture 23. Likewise, the outwardly presented curved exterior surfaces of second tabs 71, 72 fit into and mate with a circular inner edge of latch aperture 25.

Figure 10:
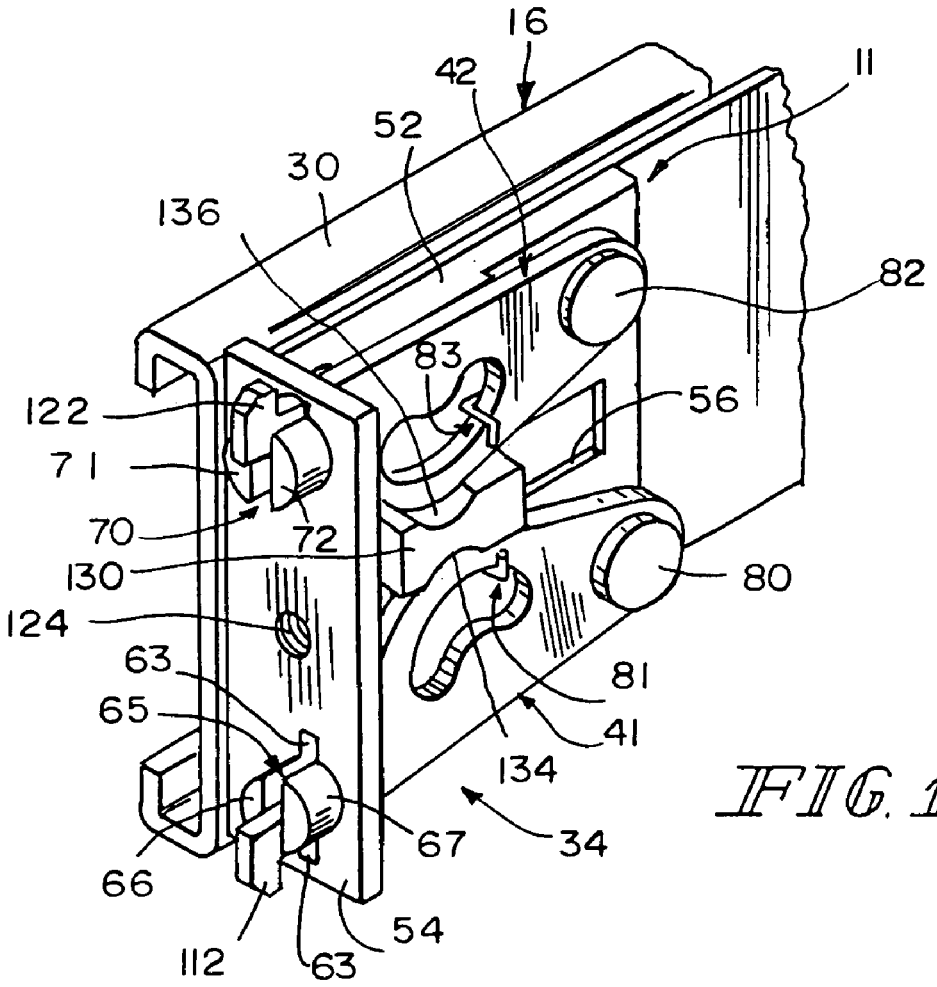
FIG. 10 is a perspective view of the quick-mount support similar to FIG. 5 showing pivotable movement of the top and bottom latches to cause the latch lugs to extend out of the channels formed in the split-cylinder alignment guides.

By inserting these alignment guides 64, 69 into two of the latch apertures (e.g., 23 and 25) formed in vertical rack 18, it is a simple matter for a technician to orient quick-mount support 11 on stationary slide 30 with rack 18 so that tips of movable latches 41, 42 are aligned and can be mated with rack 18 using latch mover 44 as suggested, for example, in FIGS. 7–9 to "anchor" stationary slide 30. As suggested in FIGS. 7–9, a "tip" 112 of bottom latch 41 extends through first slot 63 and first channel 65 associated with first alignment guide 64 and is movable therein from a first position lying within first channel 65 as shown in FIGS. 5 and 8 to a second position projecting outside first channel 65 as shown in FIGS. 9 and 10. Likewise, a "tip" 122 of top latch 42 extends through second slot 68 and second channel 70 associated with second alignment guide 69 and is movable therein from a first position lying within second channel 70 as shown in FIGS. 5 and 8 to a second position outside second channel 70 as shown in FIGS. 9 and 10.

As suggested in FIGS. 4 and 5, lower retainer 38 includes a pivotable bottom latch 41, a first pivot mount 80, and a first spring 81 and upper retainer 40 includes a pivotable top latch 42, a second pivot mount 82, and a second spring 83. First pivot mount 80 extends into a first mount aperture 84 formed in retainer mount 52 and carries first spring 81 to support bottom latch 41 for up and down pivotable movement about first pivot axis 85. Second pivot mount 82 extends into a second mount aperture 86 formed in retainer mount 52 and carries second spring 83 to support top latch 42 for up and down pivotable movement about second pivot axis 87.

In use, a movable bottom latch 41 is arranged to extend through a first (23) of the latch apertures formed in rack 18 and movable top latch 42 is arranged to extend through a second (25) of the latch apertures formed in rack 18 as suggested in FIG. 7. Latch mover 44 is arranged to move along a path between bottom and top latches 41, 42 to move the bottom and top latches 41, 42 away from one another to mate the bottom and top latches 41, 42 with rack 18 to block uncoupling of quick-mount support 11 and rack 18 as suggested in FIGS. 8 and 9.

First spring 81 is arranged to urge bottom latch 41 normally toward top latch 42. Second spring 83 is arranged to urge top latch 42 normally toward bottom latch 41. First spring 81 is arranged normally to pivot bottom latch 41 about the first latch pivot axis 85 in a clockwise direction 95 and second spring 83 is arranged normally to pivot top latch 42 about the second latch pivot axis 87 in a counterclockwise direction 96 as suggested in FIG. 7. Latch mover 44 is arranged to move relative to bottom and top latches 41, 42 in a first direction 45 to move bottom latch 41 against a biasing force applied by first spring 81 and to move top latch 42 against a biasing force applied by second spring 83 as suggested in FIGS. 8 and 9.

First spring 81 is coupled at one end 811 to mount unit 36 and at another end 812 to bottom latch 41. As suggested in FIG. 4, end 811 of first spring 81 is inserted into a first spring mount aperture 79 formed in retainer mount 52 and a straight portion of first spring 81 extending between end 811 and a coiled portion 813 abuts against an upwardly facing surface of an elongated spring block 101 appended to a lower edge of retainer mount 52. As suggested in FIG. 5, end 812 of first spring 81 passes through a second spring mount aperture 88 formed in bottom latch 41 and mates with bottom latch 41. First spring 81 includes a coiled portion 813 wrapped around first pivot mount 85 and positioned to lie between retainer mount 52 of mount unit 36 and bottom latch 41.

Second spring 83 is coupled at one end 831 to mount unit 36 and at another end 832 to top latch 42. As suggested in FIG. 4, end 831 of second spring 83 is inserted into a second spring mount aperture 89 formed in retainer mount 52 and a straight portion of second spring 83 extending between end 831 and a coiled portion 833 abuts against a downwardly facing surface of an elongated spring block 102 appended to an upper edge of retainer mount 52. As suggested in FIG. 5, end 832 of second spring 83 passes through a second spring mount aperture 90 formed in top latch 42 and mates with top latch 42. Second spring 83 includes a coiled portion 833 wrapped around second pivot mount 82 and positioned to lie between retainer mount 52 of mount unit 36 and top latch 42.

Bottom latch 41 is mounted for pivotable movement about a first latch pivot axis 85 and top latch 42 is mounted for pivotable movement about a second latch pivot axis 87. Guide slot 56 is arranged to lie between first and second springs 81, 83 and extend along a reference line 91 extending between the first and second latch pivot axes 85, 87 as suggested in FIG. 7.

As suggested in FIGS. 4 and 7–9, latch mover 44 includes a base 92 and an actuator 94 cantilevered to base 92. Mount unit 36 is formed to include a base receiver 58 having an opening in inner wall 60 of retainer mount 52 and communicating with guide slot 56. Base 92 of latch mover 44 is received in base receiver 58 to slide back and forth therein and to project actuator 94 away from stationary slide 30 through guide slot 56 and the opening into guide slot 56 and to move in guide slot 56 during movement of base 92 in base receiver 58. Actuator 94 is arranged to move (e.g., pivot) bottom and top latches 41, 42 against biasing forces provided by first and second springs 81, 83 during movement of base 92 in base receiver 58. Actuator 94 is arranged to project through and move in guide slot 56 between a retracted position allowing first and second springs 81, 83 yieldably to urge (e.g., pivot) bottom and top latches 41, 42 toward one another (as shown in FIG. 7) and an extended position moving bottom and top latches 41, 42 away from one another and against biasing forces provided by first and second springs 81, 83 (as shown in FIG. 9). Actuator 94 is arranged in guide slot 56 to lie between the first and second springs 81, 83 upon movement of the actuator to the retracted position as suggested in FIGS. 4 and 7.

As suggested in FIGS. 4 and 8, bottom latch 41 includes a base 110 intersecting first latch pivot axis 85 and providing an aperture 111 receiving a neck of first pivot mount 80, a latch lug 112 arranged to extend through the first (23) of the latch apertures formed in rack 18, and a mid-section 114 arranged to interconnect base 110 and latch lug 112 of bottom latch 41 and coupled to end 812 of first spring 81. Top latch 42 includes a base 120 intersecting second latch pivot axis 87 and providing an aperture 121 receiving a neck of second pivot mount 82, a latch lug 122 arranged to extend through the second (25) of the latch apertures formed in rack 18, and a mid-section 124 arranged to interconnect base 120 and latch lug 122 of top latch 42 and coupled to end 832 of second spring 83. As suggested in FIGS. 4 and 5, bottom latch 41 includes a cam surface 116 facing toward top latch 42 and top latch 42 includes a cam surface 126 facing toward cam surface 116 of bottom latch 41.

Latch mover 44 includes a driver 130 at one end and a tail 131 at an opposite end as shown in FIG. 5. Driver 130 is arranged to engage and move along cam surfaces 116, 126 of bottom and top latches 41, 42 as latch mover 44 is moved in guide slot 56 in direction 45 from the retracted position toward the extended position to cause bottom and top latches 41, 42 to move away from one another as suggested in FIGS. 8 and 9. Each of the cam surfaces 116, 126 is curved and convex as shown, for example, in FIG. 4.

Latch mover 44 also includes a body 132 appended to driver 130 as shown in FIGS. 4 and 5. Body 132 is formed to include a downwardly facing first latch receiver 134 sized to receive a nose portion of cam surface 116 of bottom latch 41 therein upon movement of latch mover 44 to the extended position (as shown in FIG. 9) to limit movement of latch mover 44 in guide slot 56. Body 132 is also formed to include an upwardly facing second latch receiver 136 sized to receive a nose portion of cam surface 126 of top latch 42 therein upon movement of latch mover 44 to the extended position (as shown in FIG. 9) to limit movement of latch mover 44 in guide slot 56. Thus, actuator 94 of latch mover 44 is formed to include receiver means 134, 136 for receiving nose portions of bottom and top latches 41, 42 upon arrival of latch mover 44 at the extended position to limit movement of latch mover 44 in guide slot 56 from the extended position toward the retracted position. First spring 81 and second spring 83 cooperate to provide spring means for yieldably biasing bottom latch 41 toward top latch 42 to cause the nose portion of bottom latch 41 to engage portion 134 of the receiver means upon arrival of latch mover 44 at the extended position and for yieldably biasing top latch 42 toward bottom latch 41 to cause the nose portion of top latch 42 to engage portion 136 of the receiver means upon arrival of latch mover 44 at the extended position.

Bottom latch 41 is coupled to mount unit 36 and arranged to extend through first slot 63 formed in rack mount 54 and first channel 65 formed in first alignment guide 64 and through the first (23) of the series of latch apertures formed in rack 18 to block uncoupling of the quick-mount support 11 and rack 18 as shown in FIG. 9. Top latch 42 is coupled to mount unit 36 and arranged to extend through second slot 68 formed in rack mount 54 and second channel 70 formed in second alignment guide 69, and through the second (25) of the series of latch apertures to block uncoupling of quick-mount support 11 and 18 as shown in FIG. 9. Bottom latch 41 is coupled for movement relative to mount unit 36 between an extended position (shown in FIGS. 9 and 10) wherein a bottom latch lug 112 included in bottom latch 41 extends out of first channel 65 provided in the first alignment guide 64 to confront forwardly facing surface 20 of rack 18 so as to block removal of bottom latch 41 from the first (23) of the series of latch apertures formed in rack 18 and a retracted position (shown in FIGS. 5, 7, and 8) wherein bottom latch lug 112 is located in first channel 65 provided in first alignment guide 64 so as to allow movement of bottom latch lug 112 and the pair of first tabs 66, 67 through the first (23) of the series of latch apertures. Likewise, top latch 42 is coupled for movement relative to mount unit 36 between an extended position (shown in FIGS. 9 and 10) wherein a top latch lug 122 included in top latch 42 extends out of second channel 70 provided in second alignment guide 69 to confront forwardly facing surface 20 of rack 18 so as to block removal of top latch 42 from the second (25) of the series of latch apertures formed in rack 18 and a retracted position (shown in FIGS. 5, 7, and 8) wherein top latch lug 122 is located in second channel 70 provided in second alignment guide 69 so as to allow movement of top latch lug 122 and the pair of second tabs 71, 27 through the second (25) of the series of latch apertures. Latch mover 44 is arranged to move bottom and top latches 41, 42 away from one another to assume their extended positions as shown in FIG. 9. First spring 81 is arranged to urge bottom latch 41 normally to the retracted position and second spring 83 is arranged to urge top latch 42 normally to the retracted position.

Use of a quick-mount support 11 to couple a stationary slide 30 of a telescoping slide assembly 16 to a rack 18 to assume a fixed position (of the type shown in FIGS. 1–3) is shown in FIGS. 7–9 with reference also to FIGS. 5 and 10. Prior to coupling, springs 81, 83 cooperate to pivot bottom latch 41 to a "raised and unlocked" position and to pivot top latch 42 to a "lowered and unlocked" position shown in FIGS. 5, 7, and 8. It is within the scope of this disclosure to provide a single piece of spring material to cause such pivoting movement of bottom and top latches 41, 42. In this position, latch lug 112 of bottom latch 41 lies in channel 65 formed in first alignment guide 64 as suggested in FIGS. 5, 7, and 8 and is "poised" to be passed in direction 45 through latch aperture 23 of rack 18 along with first alignment guide 64. Also, latch lug 122 of top latch 42 lies in channel 70 formed in second alignment guide 69 as suggested in FIGS. 5, 7, and 8 and is "poised" to be passed in direction 45 through latch aperture 25 of rack 18 along with second alignment guide 69.

Next, quick-mount support 11 and stationary slide 30 are moved as a unit in direction 45 as shown in FIG. 8. Such movement causes rack mount 54 to abut rearwardly facing surface 22 of rack 18, first alignment guide 64 and latch lug 112 to pass as a unit through latch aperture 23 in rack 18, and second alignment guide 69 and latch lug 122 to pass as a unit through latch aperture 25.

Then, latch mover 44 is moved relative to retainer mount 52 in direction 45 to pivot bottom latch 41 in counterclockwise direction 96 and to pivot top latch 42 in clockwise direction 95. This causes bottom latch 41 to be moved against first spring 81 to assume a "lowered and locked" position to cause a portion of latch lug 112 to extend out of channel 65 formed in first alignment guide 64 to block removal of latch lug 112 from latch aperture 23. This also causes top latch 42 to be moved against second spring 83 to assume a "raised and locked" position to cause a portion of latch lug 122 to extend out of channel 70 formed in second alignment guide 69 to block removal of latch lug 122 from latch aperture 25. In these positions, stationary slide 30 is held in a fixed position relative to rack 18 provided in cabinet 10.

What is claimed is:

1. A telescoping slide assembly support system comprising a telescoping slide assembly including load-carrying and stationary slides movable relative to one another to extend and retract the load-carrying slide relative to the stationary slide between fully extended and retracted positions, a rack formed to include a series of latch apertures, and a quick-mount support coupled to the stationary slide, the quick-mount support including a movable bottom latch arranged to extend through a first of the latch apertures, a movable top latch arranged to extend through a second of the latch apertures, and a latch mover arranged to move along a path between the bottom and top latches to move the bottom and top latches away from one another to mate the bottom and top latches with the rack to block uncoupling of the quick-mount support and the rack.

2. The system of claim 1, wherein the quick-mount support further includes a first spring arranged to urge the bottom latch normally toward the top latch, a second spring arranged to urge the top latch normally toward the bottom latch, and the latch mover is arranged to move relative to the bottom and top latches in a first direction to move the bottom latch against a biasing force applied by the first spring and to move the top latch against a biasing force applied by the second spring.

3. The system of claim 2, wherein the quick-mount support further includes a mount unit formed to include a guide slot, the latch mover is located to move back and forth in the guide slot, the first spring is coupled at one end to the mount unit and at another end to the bottom latch, and the second spring is coupled at one end to the mount unit and at another end to the top latch.

4. The system of claim 3, wherein the bottom latch is mounted for pivotable movement about a first latch pivot axis, the top latch is mounted for pivotable movement about a second latch pivot axis, and the guide slot is arranged to lie between the first and second springs and extend along a reference line extending between the first and second latch pivot axes.

5. The system of claim 3, wherein the mount unit includes an inner wall facing toward the load-carrying slide and an outer wall facing away from the load-carrying slide and providing an opening into the guide slot, the latch mover includes a base and an actuator cantilevered to the base, the mount unit is formed to include a base receiver having an opening in the inner wall and communicating with the guide slot, the base of the latch mover is received in the base receiver to slide back and forth therein and to project the actuator through the guide slot and the opening into the guide slot and to move in the guide slot during movement of the base in the base receiver, and the actuator is arranged to move the bottom and top latches against biasing forces provided by the first and second springs during movement of the base in the base receiver.

6. The system of claim 3, wherein the latch mover includes an actuator arranged to project through and move in the guide slot between a retracted position allowing the first and second springs yieldably to urge the bottom and top latches toward one another and an extended position moving the bottom and top latches away from one another and against biasing forces provided by the first and second springs and the actuator is arranged in the guide slot to lie between the first and second springs upon movement of the actuator to the retracted position.

7. The system of claim 2, wherein the bottom latch is mounted for pivotable movement about a first latch pivot axis, the top latch is mounted for pivotable movement about a second latch pivot axis, the first spring is arranged normally to pivot the bottom latch about the first latch pivot axis in a clockwise direction, and the second spring is arranged normally to pivot the top latch about the second latch pivot axis in a counterclockwise direction.

8. The system of claim 7, wherein the quick-mount support includes a mount unit, a first pivot mount is coupled to the mount unit and to the bottom latch to establish the first latch pivot axis, a second pivot mount is coupled to the mount unit and to the top latch to establish the second latch pivot axis, the first spring includes a coiled portion wrapped around the first pivot mount and positioned to lie between the mount unit and the bottom latch, and the second spring includes a coiled portion wrapped around the second pivot mount and positioned to lie between the mount unit and the top latch.

9. The system of claim 7, wherein the bottom latch includes a base intersecting the first latch pivot axis, a latch lug arranged to extend through the first of the latch apertures, and a mid-section arranged to interconnect the base and latch lug of the bottom latch and coupled to the first spring, and the top latch includes a base intersecting the second latch pivot axis, a latch lug arranged to extend through the second of the latch apertures, and a mid-section arranged to interconnect the base and latch lug of the top latch and coupled to the second spring.

10. The system of claim 1, wherein the quick-mount support includes a mount unit formed to include a guide slot and the latch mover is located to move back and forth in the guide slot between a retracted position arranged to allow the bottom and top latches to be moved toward one another and an extended position moving the bottom and top latches away from one another to mate the bottom and top latches with the vertical rack.

11. The system of claim 10, wherein the bottom latch includes a cam surface facing toward the top latch, the top latch includes a cam surface facing toward the cam surface of the bottom latch, and the latch mover includes a driver arranged to engage and move along the cam surfaces of the bottom and top latches as the latch mover is moved in the guide slot from the retracted position toward the extended position to cause the bottom and top latches to move away from one another.

12. The system of claim 11, wherein each of the cam surfaces is curved.

13. The system of claim 11, wherein each of the cam surfaces is convex.

14. The system of claim 11, wherein the latch mover includes a body appended to the driver, the body is formed to include a first latch receiver sized to receive a nose portion of the cam surface of the bottom latch therein upon movement of the latch mover to the extended position to limit movement of the latch mover in the guide slot, and the body is also formed to include a second latch receiver sized to receive a nose portion of the cam surface of the top latch therein upon movement of the latch mover to the extended position to limit movement of the latch mover in the guide slot.

15. The system of claim 14, wherein the quick-mount support further includes a first force generator coupled to the bottom latch and the mount unit and configured to urge yieldably the nose portion of the bottom latch into the first latch receiver of the latch mover and a second force generator coupled to the top latch and the mount unit and configured to urge yieldably the nose portion of the top latch into the second latch receiver of the latch mover.

16. The system of claim 10, wherein the mount unit includes an inner wall facing toward the load-carrying slide and an outer wall facing away from the load-carrying slide and providing an opening into the guide slot, the latch mover includes a base and an actuator cantilevered to the base, the mount unit is formed to include a base receiver having an opening in the inner wall and communicating with the guide slot, the base of the latch mover is received in the base receiver to slide back and forth therein between the retracted and extended positions and to project the actuator through the guide slot and the opening into the guide slot and to move in the guide slot during movement of the base in the base receiver, and the actuator is arranged to move the bottom and top latches away from one another during movement of the latch mover from the retracted position toward the extended position.

17. The system of claim 16, wherein the actuator is formed to include receiver means for receiving nose portions of the bottom and top latches upon arrival of the latch mover at the extended position to limit movement of the latch mover in the guide slot from the extended position toward the retracted position.

18. The system of claim 17, wherein the quick-mount support further includes means for yieldably biasing the bottom latch toward the top latch to cause the nose portion of the bottom latch to engage the receiver means upon arrival of the latch mover at the extended position and for yieldably biasing the top latch toward the bottom latch to cause the nose portion of the top latch to engage the receiver means upon arrival of the latch mover at the extended position.

19. The system of claim 1, wherein the quick-mount support further includes a mount unit formed to include first and second slots and a first alignment guide coupled to the mount unit and formed to include a first channel communicating with the first slot, the first alignment guide is arranged to extend through a first of the series of latch apertures, and one of the bottom and top latches is arranged to extend through the first slot and into the first channel and is coupled to the mount unit for pivotable movement about a pivot axis between an extended position wherein a latch lug included in the one of the bottom and top latch extends out of the first channel to confront the rack so as to block removal of the one of the bottom and top latches from the first of the series of latch apertures formed in the rack and a retracted position wherein the latch lug is located in the first channel to allow movement of the first alignment guide and the one of the bottom and top latches through the first of the series of latch apertures.

20. The system of claim 1, wherein the quick-mount support further includes a mount unit formed to include first and second slots, a first alignment guide formed to include a first channel and arranged to extend through a first of the series of latch apertures formed in the rack, and a second alignment guide formed to include a second channel and arranged to extend through a second of the series of latch apertures formed in the rack, the movable bottom latch extends through and is movable in the first slot and channel, and the movable top latch extends through and is movable in the second slot and channel.

21. A telescoping slide assembly support system comprising a telescoping slide assembly including load-carrying and stationary slides movable relative to one another to extend and retract the load-carrying slide relative to the stationary slide between fully extended and retracted positions, a rack formed to include a series of latch apertures, and a quick-mount support coupled to the stationary slide, the quick-mount support including a mount unit formed to include a first and second slot, a first alignment guide comprising a pair of first tabs appended to the mount unit to form a first channel therebetween opening into the first slot, a second alignment guide comprising a pair of second tabs appended to the mount unit to form a second channel therebetween opening into the second slot, the pair of first tabs extending through a first in the series of latch apertures and the pair of second tabs extending through a second in the series of latch apertures to orient the quick-mount support in a predetermined position relative to the rack, a bottom latch coupled to the mount unit and arranged to extend through the first slot, first channel, and first of the series of latch apertures to block uncoupling of the quick-mount support and the rack, and a top latch coupled to the mount unit and arranged to extend through the second slot, second channel, and second of the series of latch apertures to block uncoupling of the quick-mount support and the rack.

22. The system of claim 21, wherein the bottom latch is coupled for movement relative to the mount unit between an extended position wherein a bottom latch lug included in the bottom latch extends out of the first channel provided in the first alignment guide to confront the rack so as to block removal of the bottom latch from the first of the series of latch apertures formed in the rack and a retracted position wherein the bottom latch lug is located in the first channel provided in the first alignment guide so as to allow movement of the bottom latch lug and the pair of first tabs through the first of the series of latch apertures.

23. The system of claim 22, wherein the top latch is coupled for movement relative to the mount unit between an extended position wherein a top latch lug included in the top latch extends out of the second channel provided in the second alignment guide to confront the rack so as to block removal of the top latch from the second of the series of latch apertures formed in the rack and a retracted position wherein the top latch lug is located in the second channel provided in the second alignment guide so as to allow movement of the top latch lug and the pair of second tabs through the second of the series of latch apertures.

24. The system of claim 23, wherein the quick-mount support further includes a latch mover arranged to move the bottom and top latches away from one another to assume their extended positions.

25. The system of claim 23, wherein the quick-mount support further includes a first spring arranged to urge the bottom latch normally to the retracted position and a second spring arranged to urge the top latch normally to the retracted position.

26. The system of claim 25, wherein the quick-mount support further includes a latch mover arranged to move the bottom and top latches away from one another and against biasing forces generated by the first and second springs to assume their extended positions.

27. The system of claim 22, wherein the quick-mount support further includes a first spring arranged to urge the bottom latch normally to the retracted position.

28. The system of claim 27, wherein the quick-mount support further includes a latch mover arranged to move the bottom latch against a biasing force generated by the first spring to assume the extended position.

29. The system of claim 28, wherein the mount unit is formed to include a guide slot and the latch mover is located to move back and forth in the guide slot.

30. The system of claim 21, wherein each of the pair of first tabs has a partial cylindrical shape.

31. The system of claim 30, wherein each of the pair of second tabs has a partial cylindrical shape.

32. The system of claim 21, wherein the mount unit includes a rack mount arranged to mate with the rack to cause the pairs of first and second tabs coupled to the mount unit to extend, respectively, through the first and second in the series of latch apertures formed in the rack.

33. The system of claim 32, wherein the mount unit further includes a latch mount arranged to extend rearwardly away from the rack mount and formed to include a guide slot, the bottom and top latches are coupled for pivotable movement to the latch mount, the quick-mount support further includes a latch mover located to move back and forth in the guide slot, and the latch mover is arranged to pivot the bottom and top latches away from one another upon movement of the latch mover in the guide slot toward the rack mount.

34. A telescoping slide assembly support system comprising a telescoping slide assembly including load-carrying and stationary slides movable relative to one another to extend and retract the load-carrying slide relative to the stationary slide between fully extended and retracted positions, a rack formed to include a series of latch apertures, and a quick-mount support coupled to the stationary slide, the quick-mount support including a mount unit including a rack mount formed to include first and second slots and adapted to mate with the rack to align the first and second slots with latch apertures formed in the rack, a latch mount arranged to extend away from the rack and formed to include a guide slot, a first alignment guide coupled to the rack mount and formed to include a first channel communicating with the first slot, and a second alignment guide coupled to the rack mount and formed to include a second channel communicating with the second slot, a bottom latch coupled to the latch mount for pivotable movement about a first pivot axis and arranged to extend through the first slot, first channel, and a first of the series of latch apertures, a top latch coupled to the latch mount for pivotable movement about a second pivot axis and arranged to extend through the second slot, second channel, and a second of the series of latch apertures, spring material coupled to the latch mount and arranged to pivot the bottom and top latches normally toward one another, and a latch mover arranged to move back and forth in the guide slot in a first direction to pivot the bottom and top latches away from one another against biasing force generated by the spring material to mate the bottom and top latches with the rack to block uncoupling of the quick-mount support and the rack and in a second direction to allow the spring material to pivot the bottom and top latches toward one another to allow uncoupling of the quick-mount support and the rack.

* * * * *